US006914998B2

(12) United States Patent
Watanabe

(10) Patent No.: US 6,914,998 B2
(45) Date of Patent: Jul. 5, 2005

(54) SPEAKER APPARATUS

(75) Inventor: Shigeru Watanabe, Tendo (JP)

(73) Assignees: Pioneer Corporation, Tokyo (JP); Tohoku Pioneer Corporation, Yamagata-ken (JP)

( * ) Notice: Subject to any disclaimer, the term of this patent is extended or adjusted under 35 U.S.C. 154(b) by 579 days.

(21) Appl. No.: 09/835,097

(22) Filed: Apr. 16, 2001

(65) Prior Publication Data

US 2002/0018577 A1 Feb. 14, 2002

(30) Foreign Application Priority Data

Aug. 7, 2000 (JP) ..... 2000-238091

(51) Int. Cl.[7] ..... H04R 1/00

(52) U.S. Cl. ..... 381/412; 381/413; 381/418; 381/421

(58) Field of Search ..... 381/396, 412, 381/417, 430, 432, 398, 423, 407, 96, 408, 162, 166, 418, 421, 420, 419, 165, 405, 413, 76

(56) References Cited

U.S. PATENT DOCUMENTS 3,310,131 A * 3/1967 Ward ..... 381/396
4,284,857 A * 8/1981 Slavin et al. ..... 381/394
5,625,699 A * 4/1997 Yamada ..... 381/99
5,701,357 A * 12/1997 Matsuo et al. ..... 381/412
6,370,257 B1 * 4/2002 Bleim et al. ..... 381/409

* cited by examiner

*Primary Examiner*—Rexford Barnie
(74) *Attorney, Agent, or Firm*—Morgan, Lewis & Bockius LLP

(57) ABSTRACT

A speaker arrangement in which a diaphragm does not displace in directions other than a regular oscillating direction. The speaker arrangement includes a magnetic circuit having a magnetic gap, a voice coil located in the magnetic gap, a voice coil bobbin having the voice coil wound thereon, a diaphragm mounted on the voice coil bobbin, a hollow portion extending in a longitudinal direction of the voice coil bobbin and defined inside that portion of the magnetic circuit which is surrounded by the voice coil, an elongated rod inserted in the hollow portion of the magnetic circuit and fixed to the diaphragm, and at least one support member located at a predetermined position in the hollow portion of the magnetic circuit for movably supporting the elongated rod in the magnetic circuit hollow portion.

17 Claims, 2 Drawing Sheets

SPEAKER APPARATUS

BACKGROUND OF THE INVENTION

1. Field of the Invention

The present invention relates to an electro-acoustic transducer such as a speaker, and more particularly to a speaker apparatus for bass reproduction.

2. Description of the Related Art

An electrodynamic speaker, half of which is shown in partial cross-sectional view in FIG. 1, is known as an electro-acoustic transducer. In this electrodynamic speaker, a pole yoke 1 projects from a center of a back plate, and a magnet 2 is provided around the pole yoke 1. A top plate 3 is located on the magnet 2 such that the top plate and pole yoke 1 in combination create a magnetic gap therebetween thereby forming a magnetic circuit. The top plate 3 is secured on a diaphragm 8 and a magnetic circuit frame 5. A voice coil bobbin 4 having a voice coil 4*a* wound thereon is oscillatably located in the magnetic gap, and is supported by a damper 7. A center portion of a cone-shaped diaphragm 8 is connected to the voice coil bobbin 4, and a center cap 6 is placed over a truncated portion of the cone-shaped diaphragm. A periphery of an opening of the diaphragm 8 is supported by the frame 5 via an edge 9. A lead of the voice coil 4*a* is connected to a terminal provided on the frame 5 by means of a colored cable.

As described above, in the electrodynamic speaker unit having a typical conventional drive, the voice coil is located in the magnetic circuit and an audio signal is input to the voice coil such that an electromagnetic force generated according to Fleming's left hand rule is used to drive the voice coil and in turn the diaphragm connected to the voice coil, thereby causing the air to oscillate.

OBJECTS AND SUMMARY OF THE INVENTION

Generally, the bass speaker has a diaphragm of large area to ensure an output sound pressure level, and suppresses a low tone resonance frequency $fo=(so/mo)1/2/2\pi$ where so represents stiffness of a diaphragm support and mo represents an effective mass of a vibrating system.

In recent years, size reduction is also demanded to bass speakers. In order to insure the output sound pressure level, the bass speaker needs to have a large amplitude in the diaphragm. If the amplitude is enlarged, however, the diaphragm moves in directions other than a proper oscillating direction, i.e., direction of piston action. In other words, in the case of a conical diaphragm which is symmetrical to a rotation axis, the diaphragm oscillates in a direction deviated from the rotation axis, i.e., direction of rolling motion.

In order to overcome such drawbacks, the present invention has an object to provide a speaker apparatus that does not displace in directions other than a regular direction.

According to one aspect of the present invention, there is provided a speaker apparatus that includes a magnetic circuit having a magnetic gap, a voice coil located in the magnetic gap, a voice coil bobbin having the voice coil wound thereon, a diaphragm mounted on the voice coil bobbin, a hollow portion defined in that portion of the magnetic circuit which is surrounded by the voice coil such that it extends in a longitudinal direction of the voice coil bobbin, an elongated rod inserted in the hollow portion of the magnetic circuit and fixed to the diaphragm, and a support member located at a predetermined position in the hollow portion of the magnetic circuit for movably supporting the elongated rod in the magnetic circuit hollow portion such that the elongated rod is only allowed to oscillate in a regular oscillating direction of the diaphragm.

The respective support member may be made from a material of smaller friction coefficient than that portion of the magnetic circuit which surrounds the hollow portion.

The support member may be a ceramic.

Alternatively, the support member may be a bearing.

The diaphragm may have an annular or conical shape, and the voice coil bobbin may support an inner periphery of the diaphragm.

The diaphragm may have an annular or conical shape, and the elongated rod may support an inner periphery of the diaphragm.

The diaphragm may be planar.

The speaker apparatus may further include a frame connected to the magnetic circuit, and an outer periphery of the diaphragm may be mounted on the frame.

The elongated rod and the diaphragm may be fixed to each other via a coupling element.

The respective support member may be made from a heat-resistive material having a softening point higher than that portion of the magnetic circuit which surrounds the hollow portion.

The elongated rod may be made from a heat-resistive material having a softening point higher than that portion of the magnetic circuit which surrounds the hollow portion.

DETAILED DESCRIPTION OF THE PREFERRED EMBODIMENTS

Embodiments of electro-acoustic transducer according to the present invention will now be described in reference to the drawings.

Figure 1:
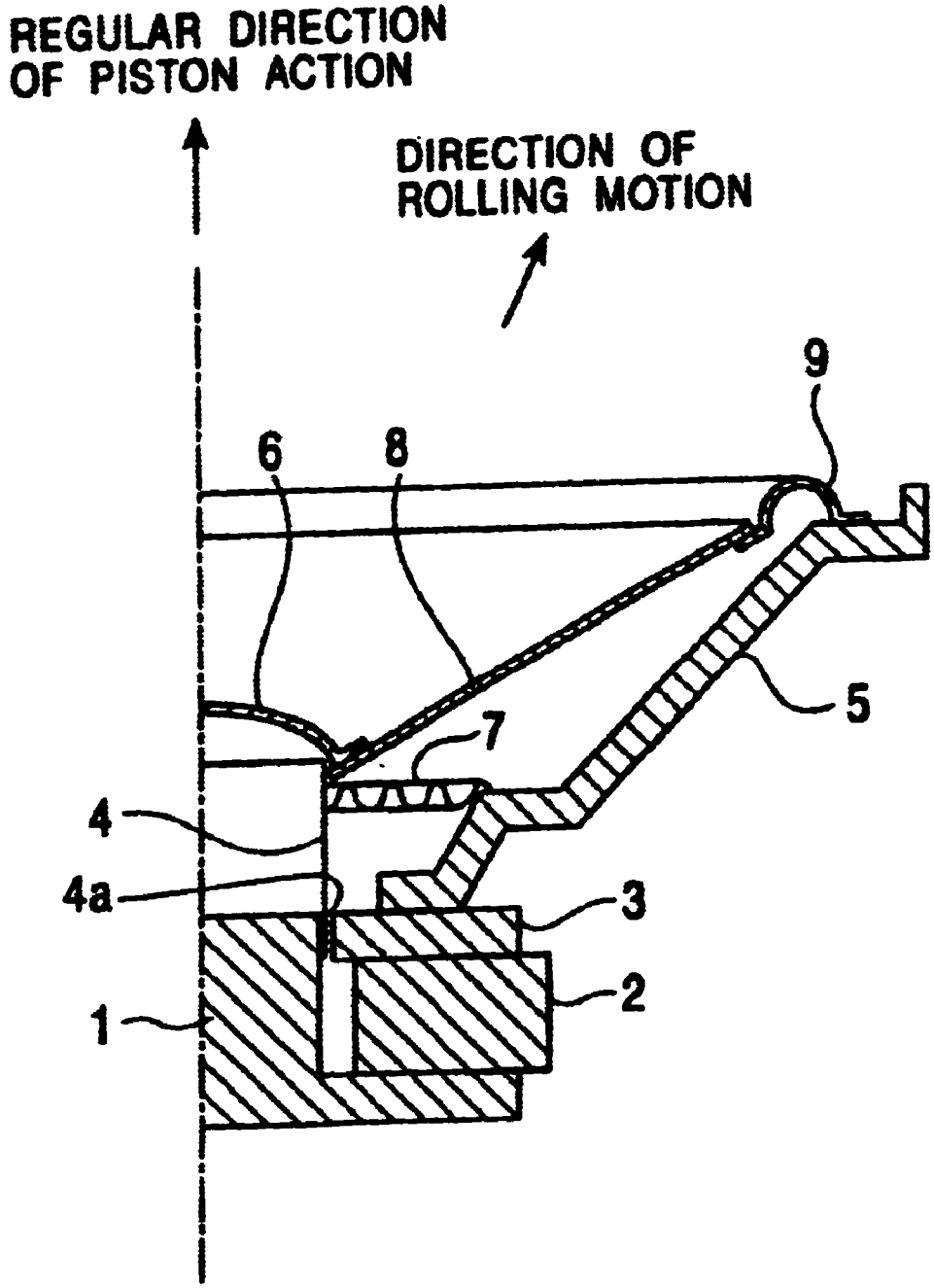
FIG. 1 illustrates a schematic partial cross sectional view of a conventional electrodynamic speaker.
Figure 2:
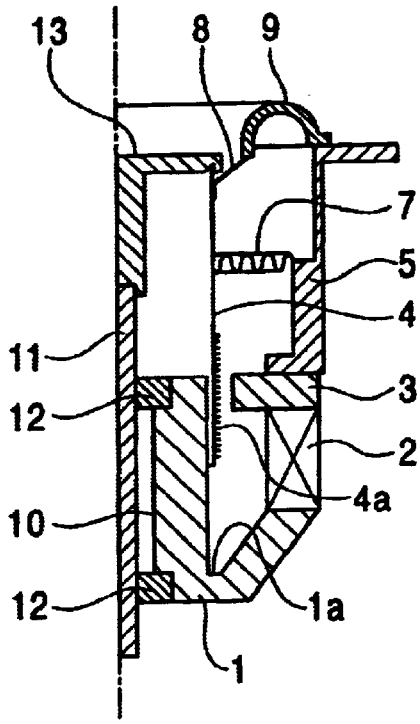
FIG. 2 illustrates a schematic partial cross sectional view of a speaker according to an embodiment of the present invention.

As illustrated in FIG. 2, an electro-acoustic transducer of the invention has an annular magnetic circuit, which is defined by a yoke 1, a magnet 2 and a top plate 3. A voice coil bobbin 4 having a voice coil 4*a* wound thereon is located such that the voice coil 4*a* is situated in a magnetic gap formed between an outer periphery of an upper end of a center pole of the yoke 1 and an inner periphery of the top plate 3. The voice coil bobbin 4 is elongated in an oscillating direction for large amplitude oscillation. In order to prevent the voice coil bobbin 4 from colliding against the yoke 1, the yoke 1 has a recess 1*a* in its root portion which is subjected to the voice coil bobbin.

An annular diaphragm such as one having a cone shape 8 is mounted on the voice coil bobbin 4 such that the voice coil bobbin 4 supports the inner periphery of the diaphragm, and the outer periphery edge 9 of the diaphragm is connected to the frame 5. It should be noted that the diaphragm 8 may be planar. The frame 5 is mounted on the top plate 3.

A predetermined portion of the voice coil bobbin 4 is coupled to the frame 5 via a damper 7. The damper 7 is formed from a substantially soft material to obtain a low stiffness for reproduction of low tone sound such as sound of 150 Hz. It should be noted that the damper may be negligible.

A cylindrical hollow portion 10 is formed in a center portion of the yoke 1 surrounded by the voice coil 4*a* such that it extends in a longitudinal direction of the voice coil bobbin 4 and penetrates the yoke. An elongated rod 11 is fitted in this hollow portion 10 such that it can move in the axial direction of the hollow portion 10. Support members 12 having a small friction coefficient such as bearings and ceramic elements are mounted on an inner surface of the hollow portion 10 of the yoke such that they contact the elongated rod 11. Thus, the elongated rod 11 inserted in the hollow portion 10 of the magnetic circuit so as to penetrate the hollow portion 10 is secured to the diaphragm 8 and projects from the diagram to movably support the diaphragm. The support members 12 are made from a material having a friction coefficient smaller than that of the material of the yoke surrounding the hollow portion of the magnetic circuit. The support members 12 are spacedly located from each other in the penetrating hollow portion 10 in the center axis direction of the hollow portion 10 such that the elongated rod 11 only performs a regular piston action (reciprocating movement). Since heat is transferred to the support members 12 from the voice coil 4*a* via the yoke 1, the support members 12 are formed from a highly heat-resistive material. Preferably the ceramic is employed as the heat-resistive material. The support members 12 are made from a heat-resistive material having a softening or melting point higher than that of the yoke material.

The elongated rod 11 is fixed to the diaphragm 8 and movably supports the diaphragm. In this arrangement, however, a connection element 13 is provided on an upper portion of the elongated rod 11 (on the side of the diaphragm 8) such that it has a main surface directed in a direction of acoustic radiation and the elongated rod is fixedly connected to the voice coil bobbin 4. It should be noted that the connection element 13 may have a planar main surface (flange) at its top to mount the voice coil bobbin and diaphragm thereon. Further, the elongated rod 11 and the coupling element 13 may be formed integrally. Moreover, the coupling element 13 may not be provided and a free end of the elongated rod 11 may directly be connected to the inner periphery of the diaphragm 8.

When the diaphragm 8 is driven and caused to move up and down in a large amplitude, it tends to move in directions other than a regular oscillating direction. However, the elongated rod 11 only displaces in the center axis direction of the hollow portion 10, i.e., the regular oscillating direction so that a rolling motion of the diaphragm 8 is prevented.

In this instance, it is to be understood that the elongated rod 11 is more effective for suppressing the rolling motion of the diaphragm 8 in case of a speaker apparatus with characteristics for reproducing low frequency sounds in which the damper 7 is usually so soft that it is not so effective for suppressing the rolling motion of the diaphragm 8.

The friction between the elongated rod 11 and the inner wall of the hollow portion 10 is made small due to the support members 12 having a small friction coefficient so that it does not adversely influence the oscillation of the diaphragm 8, and unnecessary sound will not be generated by the contacting between the supporting rod 11 and the inner wall of the hollow portion 10.

Figure 3:
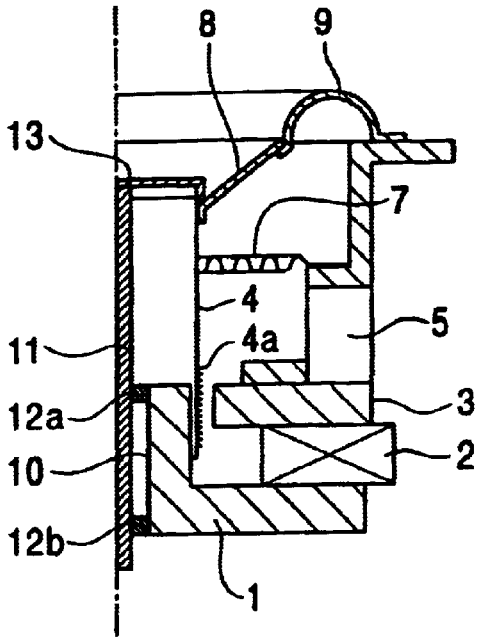
FIG. 3 illustrates a schematic partial cross sectional view of a speaker according to another embodiment.

Referring to FIG. 3, illustrated is another embodiment of the present invention. In the first embodiment, a pair of support members 12 attached to the inner surface of the hollow portion 10 of the yoke are made from the same material, i.e., either the bearing or the ceramic. In this second embodiment, a pair of supporting members are different members. Specifically, the support member 12*a* close to the diaphragm 8 is the bearing and the farther support member 12*b* is the ceramic, or vice versa.

As understood from the foregoing, since the speaker apparatus of the present invention includes the hollow portion formed in the magnetic circuit and extending in the longitudinal direction of the voice coil bobbin, the elongated rod inserted in the hollow portion and secured to the diaphragm, and at least one support member for supporting the elongated rod such that the elongated rod can move freely in the hollow portion in the regular oscillating direction of the diaphragm, it is a speaker apparatus of which diaphragm does not move in directions other than the regular oscillating direction.

What is claimed is:

1. A speaker apparatus comprising:

a magnetic circuit having a magnetic gap;

a voice coil located in the magnetic gap;

a voice coil bobbin having the voice coil wound thereon;

a diaphragm mounted on the voice coil bobbin;

a hollow portion defined in that portion of the magnetic circuit which is surrounded by the voice coil, the hollow portion extending in a longitudinal direction of the voice coil bobbin;

an elongated rod frictionally fit within the hollow portion of the magnetic circuit and fixed to the diaphragm; and at least one support member located at a predetermined position in the hollow portion of the magnetic circuit for movably supporting the elongated rod in the hollow portion of the magnetic circuit such that the elongated rod is only allowed to oscillate in a regular oscillating direction of the diaphragm.

2. The speaker apparatus according to claim 1, wherein the support member is made from a material of smaller friction coefficient than that portion of the magnetic circuit which surrounds the hollow portion.

3. The speaker apparatus according to claim 2, wherein the support member is a ceramic.

4. The speaker apparatus according to claim 2, wherein the support member is a bearing.

5. The speaker apparatus according to claim 1, wherein the diaphragm has an annular or conical shape, and the voice coil bobbin supports an inner periphery of the diaphragm.

6. The speaker apparatus according to claim 1, wherein the diaphragm has an annular or conical shape, and the elongated rod supports an inner periphery of the diaphragm.

7. The speaker apparatus according to claim 1, wherein the diaphragm is planar.

8. The speaker apparatus according to claim 1 further including a frame connected to the magnetic circuit, and wherein an outer periphery of the diaphragm is mounted on the frame.

9. The speaker apparatus according to claim 1, wherein the elongated rod and the diaphragm are fixed to each other via a coupling element.

10. The speaker apparatus according to claim 1, wherein the respective support member is made from a heat-resistive material having a softening point higher than that portion of the magnetic circuit which surrounds the hollow portion.

11. The speaker apparatus according to claim 1, wherein the elongated rod is made from a heat-resistive material having a softening point higher than that portion of the magnetic circuit which surrounds the hollow portion.

12. A speaker apparatus comprising:

a magnetic circuit having a magnetic gap;

a voice coil located in the magnetic gap;

a voice coil bobbin having the voice coil wound thereon, the voice coil bobbin having a longitudinal direction;

a diaphragm mounted on the voice coil bobbin;

a hollow portion formed in that portion of the magnetic circuit which is surrounded by the voice coil, the hollow portion extending in the longitudinal direction of the voice coil bobbin; and a rod frictionally fit within the hollow portion of the magnetic circuit such that the rod can move in the longitudinal direction of the voice coil bobbin, the rod being fixed to the diaphragm to support the diaphragm.

13. A speaker apparatus comprising:

a yoke having a longitudinal direction;

a magnet mounted on the yoke such that the yoke and the magnet in combination form a magnetic circuit, the magnetic circuit having a magnetic gap;

a voice coil located in the magnetic gap;

a voice coil bobbin having the voice coil wound thereon;

a diaphragm mounted on the voice coil bobbin;

a hollow portion formed in the yoke such that the hollow portion extends in the longitudinal direction of the yoke; and a rod frictionally fit within the hollow portion of the yoke such that the rod can move in the hollow portion, the rod being fixed to the diaphragm.

14. The speaker apparatus according to claim 13 further comprising at least one support member located in the hollow portion for movably supporting the rod in the hollow portion.

15. The speaker apparatus according to claim 14, wherein each of the at least one support member is a bearing.

16. The speaker apparatus according to claim 14, wherein each of the at least one support member is made from a ceramic.

17. The speaker apparatus according to claim 14, wherein the support member is a bearing.

* * * * *